United States Patent [19]

Young et al.

[11] Patent Number: 5,054,542

[45] Date of Patent: Oct. 8, 1991

[54] HEAT TRANSFER SYSTEM

[75] Inventors: Tommis E. Young; John L. Curtis; Dennis A. Barnett, all of Las Vegas, Nev.

[73] Assignee: Thermotaxis Development, Inc., Las Vegas, Nev.

[21] Appl. No.: 405,735

[22] Filed: Sep. 11, 1989

[51] Int. Cl.[5] ..... F25B 27/00; G04D 23/00

[52] U.S. Cl. ..... 165/58; 62/238.6; 62/235.1; 237/2 B

[58] Field of Search ..... 237/2 B; 62/238.6, 235.1, 62/324.1, 324.6; 165/58, 61, 62, 63, 64

[56] References Cited

U.S. PATENT DOCUMENTS

| | | | |
|---|---|---|---|
| 4,290,272 | 9/1981 | Vakil | 237/2 B |
| 4,294,078 | 10/1981 | MacCracken | 62/430 X |
| 4,448,039 | 5/1984 | Hutchins | 62/235.1 |
| 4,553,402 | 11/1985 | Cramer, Sr. | 62/235.1 |
| 4,633,676 | 1/1987 | Dittell | 62/238.6 |
| 4,722,197 | 2/1988 | McEntire | 62/238.1 |
| 4,827,735 | 5/1989 | Foley | 62/430 |

*Primary Examiner*—Henry A. Bennet

*Attorney, Agent, or Firm*—Quirk, Tratos & Roethel

[57] ABSTRACT

A heat transfer system for a building and the building's appurtenances utilizes a heat transfer medium that obtains heat from environmental panels. The heat transfer medium flows in a unidirectional mode through the system. The heat transfer medium is passed through heat exchangers where the heat values in the medium are exchanged or transferred to water to raise the temperature of the water which is then subsequently used as hot water for appurtenant building uses. The heat transfer system, independently from the ambient heat obtainable from the environmental panels, can also utilize heat drawn from air conditioning units to both cool the air passing through the air conditioners and to heat the heat transfer medium. This heat is then exchanged or transferred to the various water sources for use in the appurtenant building uses. An electrical control system selectively transfers the available heat values to those appurtenant building uses, giving preference to those uses as determined by the operator. Temperature sensors are used to trigger the control system and excess heat is only dispersed to the outside air as a last resort.

44 Claims, 6 Drawing Sheets

HEAT TRANSFER SYSTEM

BACKGROUND OF THE INVENTION

This invention relates to a heat transfer system, and more particularly to a heat transfer system that selectively uses the heat transfer medium to heat or cool different areas of the building and the building appurtenances as conditions dictate.

Conventional heating and cooling systems used in buildings, whether residential, commercial or industrial, principally utilize separate units to provide heating and cooling. When heating is desired, air is fed through a central heating unit in which the air is heated to the appropriate temperature utilizing natural gas, electricity or even heating oil. When cooling is desired, air is fed through an air conditioning unit in which the air is cooled to the appropriate temperature by having the air come into contact with and pass over refrigerant coils that contain a refrigerant that has been cooled by running the refrigerant through a condenser. Building appurtenances, such as swimming pools, jacuzzis, clothes washers, dishwashers and shower units are also provided with hot water from hot water tanks or separate independent heating units in which the water is heated using natural gas or electricity. It is not unusual on a typical summer day in most cities to find the inhabitants of a building running the air conditioner to cool the interior of the building. At the same time the pool heater is being utilized to add hot water to either the swimming pool or the jacuzzi to increase the temperature of these building appurtenances to make their use more comfortable. The hot water tank is also being used to heat water for use in clothes washers, shower units and dishwashers.

Conventional building air conditioning cooling systems are unable to utilize the heat removed in the air conditioner to heat the water being passed through the hot water tank, the swimming pool or the jacuzzi. The heat removed from the air passing through the air conditioner is simply vented to the outside thus wasting any heat value that may exist therein. Public energy utilities are often taxed to their capacity to provide the power necessary to operate both the building's air conditioner and the building's appurtenant uses.

Because of the growing scarcity of fossil fuels and the ever increasing cost of electricity, much research and development has gone into developing alternative ways to heat and cool a building, as well as providing hot water for the building appurtenances. Solar heating systems have become a favorite candidate for research because the energy from the sun can be considered a virtually inexhaustible supply.

One particular system for heating and cooling using solar energy is disclosed in U.S. Pat. No. 4,722,197 to McEntire. This system uses Freon® 502 as the refrigerant heat transfer medium. The heat transfer medium passes in a unidirectional flow through ambient energy absorbing panels 12 in which the medium is heated to a gaseous state. The gaseous medium leaves the panels 12 and goes to a compressor 18 in which the medium is compressed into a liquid state. The hot liquid medium is then sent to one or both of two heat exchanger coils 22 and/or 26 where the heat in the hot liquid medium is transferred to water. The exiting cooler medium is then collected in a receiver 30. The heat transfer medium in the receiver 30 is then sent to a precooler 32 where the medium is air-cooled further by a fan 34. The medium is then sent through an expansion valve 38 where the medium expands and vaporizes, resulting in a further drop in temperature. The medium, now again in the gaseous state but at a lower temperature, is passed through a third heat exchanger 40 where the heat from inside air is transferred to the medium, thus cooling the inside air for air conditioning. The gaseous medium leaving the third heat exchanger 40 is passed back to the panels 12 to absorb more heat. If air conditioning is not desired, the hot liquid medium in the receiver 30 can be sent directly to the panels 12 for reheating. Alternatively, the first heat exchanger 22 and/or the second heat exchanger 26 can also be bypassed with the medium going directly into receiver 30 and from there into the third heat exchanger 40.

The system disclosed in the McEntire patent at all times passes the heat transfer medium through the panels 12. Thus on hot summer days, the heat transfer medium is always subjected to additional heating from the panels which inhibits the ability of the heat transfer medium to remove heat from the inside air to effect air conditioning of the building. The panels 12 are not segregated in a way that would permit selective utilization of either all or only a part of the panels 12.

There are no temperature controls on the heat transfer fluid as it leaves the panels 12—if the heat transfer fluid leaving the panels is too high in temperature, such would effect the ability of the compressor to operate properly. Furthermore, the use of the precooler 32 is an additional draw on external energy supplies to operate the system and decreases the system's efficiency.

The system of the McEntire patent also does not have a priority control system that will allow the system to be selectively biased to always ensure that hot water for the showers, clothes washer and dishwasher is always available before heated water is provided to a pool.

It is an object of the present invention to provide a unidirectional heat transfer system that systematically utilizes heat values stored in a heat transfer medium to selectively provide hot water to a hot water tank, a swimming pool, a jacuzzi or a room space heater as each of those uses so demand to be supplied. Separate hot water supplies are utilized to maintain potable water separate from non-potable water as is required by most building codes. The heat values to be put into the heat transfer medium can be obtained from environmental panels or from the heat obtained from the building during the air conditioning cycle. It is a further object of the present invention to provide a priority system to ensure that hot water is always available first for particular appurtenant uses before the hot water is made available for uses lower on the priority. The control system also permits changing the priority at the whim of the user.

It is a feature of the present invention that a heat transfer medium is provided with heat values from either ambient environmental panels or from the hot air inside the building. The heat transfer medium is used to cool the air as it passes through air handlers and then this cool air is sent throughout the building to air condition the building. The heat values obtained during the cooling of the air are retained in the heat transfer medium. The heat transfer medium is then used to transfer these heat values to either potable or non-potable water supplies which are then selectively passed to those areas and appurtenances of the building that require heating. The entire system operates in a unidirectional mode and utilizes an electrical control system that automatically senses the needs of the building and its appurtenances for heating and cooling, and operates based on a user-selectible priority basis to ensure hot water is available for higher priority uses before it is made available for lower priority uses.

It is an advantage of the present invention that heat generated either by the ambient environment or from the hot air which is being drawn through the air conditioning system of the building can be utilized as a source of heat to provide heat values to a heat transfer medium that is then used to heat water for a hot water tank, a swimming pool, a jacuzzi or a room space heater. Only as a last resort is heat passed to the outside of the building and not used in the system. The heat transfer medium also is used to cool air that is being used for air conditioning of the building. The heat transfer medium flows through the system in a unidirectional mode which eliminates the requirements of reversing valves that are necessary in the traditional heat pump systems.

The system of the present invention will lower heating and cooling costs for a typical building having the basic appurtenances in use today. Heat values are not wasted but rather transferred from one area of the building where they are not needed or wanted to other areas of the building where the demand exists.

SUMMARY OF THE INVENTION

A heat transfer system for a building and the building's appurtenances utilizes a heat transfer medium that obtains heat from environmental panels. The heat transfer medium flows in a unidirectional mode through the system. The heat transfer medium is passed through heat exchangers where the heat values in the medium are exchanged or transferred to water to raise the temperature of the water which is then subsequently used as hot water for appurtenant building uses such as in the hot water heater (for clothes washers, dishwashers, showers) and in the swimming pools, jacuzzis or room space heaters. The water sources are maintained separately as either potable or non-potable water with each having its own distinct heat exchanger. The heat transfer system, independently from the ambient heat obtainable from the environmental panels, can also utilize heat drawn from air conditioning units to both cool the air passing through the air conditioners and to heat the heat transfer medium. This heat is then exchanged or transferred to the various water sources for use in the appurtenant building uses. An electrical control system selectively transfers the available heat values to those appurtenant uses as determined by the operator of the building, giving preference to those uses as determined by the operator. Temperature sensors are used to trigger the control system and excess heat is only dispersed to the outside air as a last resort.

DETAILED DESCRIPTION OF THE PREFERRED EMBODIMENTS

Figure 1:
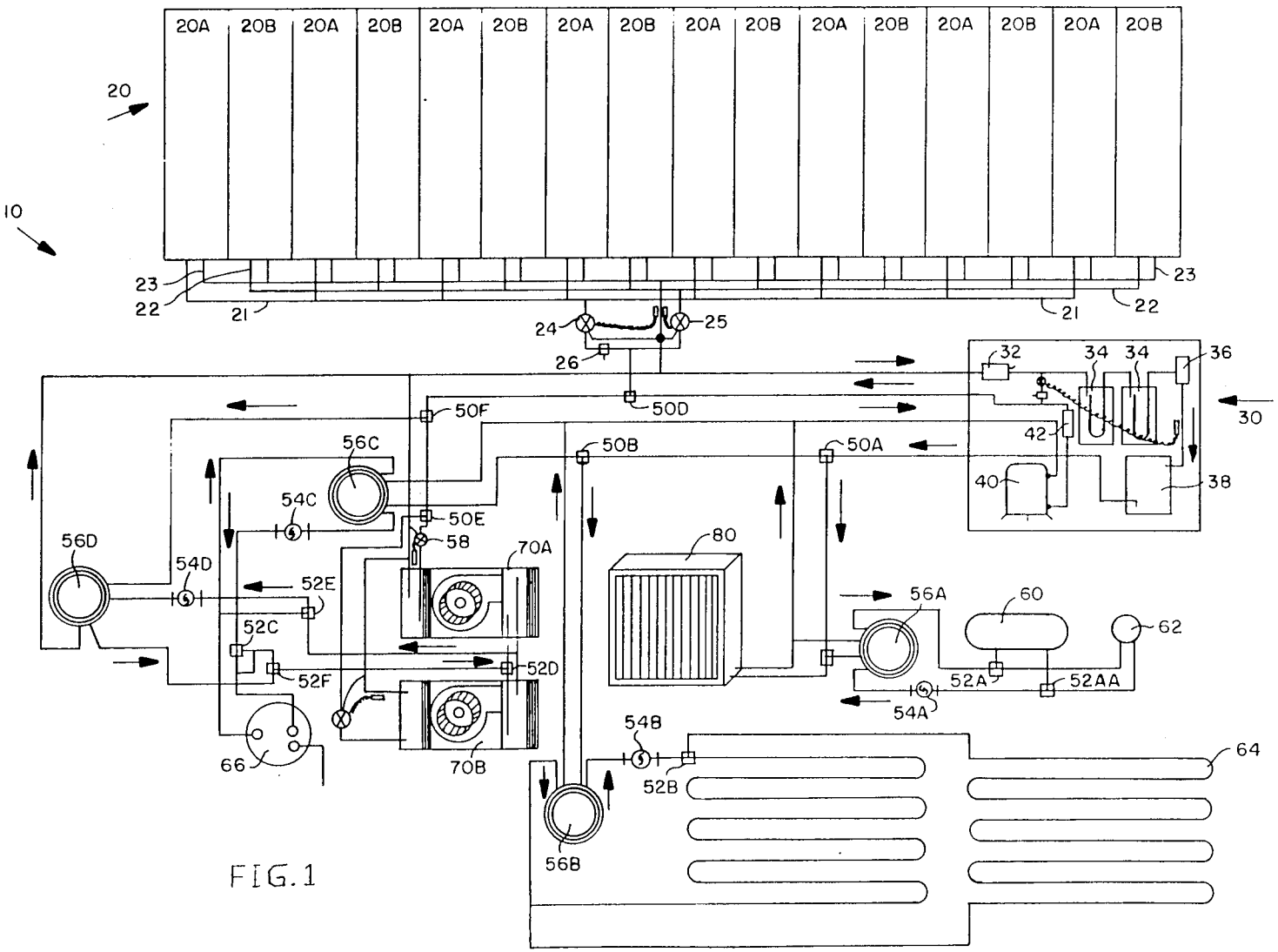
FIG. 1 shows schematically the heat transfer system of the present invention.

The heat transfer system of the present invention is shown generally at 10 in FIG. 1. The system includes as its basic elements a series of environmental panels 20, a heat transfer medium handling station 30, a plurality of helix coils 56 and various appurtenant devices that will be the users of heat values generated and recycled through the heat transfer system 10. The preferred appurtenant devices used in the heat transfer system 10 are a swimming pool 60, a jacuzzi 62, a hydronic hose 64 for room space heating, a hot water tank 66, one or more air handlers 70 for heating or cooling the entire building or selected zones of the building and a direct expansion condenser coil 80 for exhausting excess heat to the outside environment.

The environmental panels 20 are preferably disposed in two groups of panels 20A and 20B and would preferably be mounted on the exposed outer surface of the roof of the building, although other conventional ways of utilizing environmental panels may be used without departing from the spirit of the invention. This preferred arrangement provides the maximum exposure of the environmental panels 20 to the rays of the sun to achieve optimum utilization of the available solar energy. Such an arrangement also provides the maximum surface area for the environmental panels 20 so that the heat transfer medium being circulated through the environmental panels 20 has the greatest opportunity to receive heat values from the ambient environment.

The grouping of the panels in the preferred embodiment is an alternating arrangement of panel 20A, then 20B, then 20A, then 20B, etc. as shown in FIG. 1. This particular grouping however is not critical. Any appropriate grouping can be utilized, such as all of the panels 20A at one end of the roof and all of the panels 20B at the other end of the roof.

The first group of environmental panels 20B are connected together by a first inlet line 22 which is used to circulate the heat transfer medium through the first group of environmental panels 20A. A first inlet expansion valve 25 is used to regulate the inflow of the heat transfer medium through the first group of environmental panels 20B. The second group of environmental panels 20A are all connected together by a second inlet line 21 which is used to circulate the heat transfer medium through the second group of environmental panels 20A. A second inlet expansion valve 24 is used to regulate the inflow of the heat transfer medium through the second group of environmental panels 20B. A solenoid valve 26 controls the operation of the second inlet expansion valve 24. In the preferred embodiment, the system is constructed in such a way that the heat transfer medium, when directed to the environmental panels 20, will always flow through the first inlet expansion valve 25 into the first group of panels 20B. If the heat transfer needs of the system require additional heat values, the solenoid valve 26 is activated to permit the heat transfer medium to also flow through the second inlet expansion valve 24 into the second group of environmental panels 20A. All of the environmental panels 20 are joined together by a common outlet line 23 which feeds the heat transfer fluid after it leaves the environmental panels 20 to the heat transfer medium handling station 30. It is of course possible to use two solenoid valves, one for each group of panels to selectively control the flow of the heat transfer medium to either or both of the groups of panels.

By separating the environmental panels 20 into a first group of panels 20B and a second group of panels 20A, the system can operate using only half of the environmental panels 20 at one time if the ambient weather conditions so require. The number of groups of panels is not critical. Depending on the size, cost and requirements of the system any number of groups of panels can be used, each with its own associated solenoid valve. Also the number of panels in each group can vary. It is suggested that separate inlet lines and expansion valves be provided for each panel to optimize the ability to control the amount of heat transfer medium going through the environmental panels and thus control the amount of heat values that are being added to the heat transfer medium.

The environmental panels 20 can be any conventional environmental panel such as Type-A panels made by Austral Crane Co., 15-23 O'Riordan Street Alexandria, G.P.O. Box 7015, . Sydney, N.S.W. 2001 Australia. The expansion valves are also conventional expansion valves such as Model No. TCLE7.5FW6A, made by Alco Controls, Inc., P.0. Box 12700, St. Louis, Mo. 63141. The solenoid valve 26 is also a typical solenoid valve made by Alco Controls, Model No. 200RB5S5.

The heat transfer medium handling station 30 regulates the flow of the heat transfer medium through the heat transfer system 10 and controls the distribution of the heat transfer medium to those appurtenant uses in the heat transfer system 10 that require heat values. Heat transfer medium leaving the environmental panels 20 by outlet line 23 is passed downstream through a filter drier 32. An appropriate type of filter drier would be Model No. ASD50S9VV made by Alco Controls. From the filter drier 32, the heat transfer medium flows into a series of accumulators 34, only two of which are shown. More or less than two accumulators 34 may be used depending on the volume of heat transfer medium in the heat transfer system 10 and the number of appurtenant uses disposed within the heat transfer system 10. A suitable accumulator is Model No. S-77061 made by AC&R Components, Inc., 701 S. Main Street, Chatham, Ill. 62629.

A crankcase pressure regulator valve 36 regulates the pressure of the heat transfer medium into the compressor 38 which is located downstream from the accumulators 34. A typical crankcase pressure regulator valve that can be used is Model No. OPR-10, made by Alco Controls. A conventional compressor can be used such as Model No. AG4543A, made by Tecumseh Products Co., Tecumseh, Mich. 49826.

From the compressor 38, the heat transfer medium is sent to the various appurtenant uses that need heat values as determined by the control system. When the heat values in the heat transfer medium have been transferred to the water for use in the various appurtenant uses in the heat transfer system 10, the now cooled heat transfer medium is returned to heat transfer medium handling station 30 and collected in the receiver 40 where it is stored for reheating. An appropriate receiver that can be used in the system is Model No. UR-28, made by Standard Refrigeration Co., 2050 No. Ruby Street, Melrose Park, Ill. 60160. The heat transfer medium is then recycled from the receiver 40 through a filter drier 42, then through reclaim valve 50D and back to the environmental panels 20 for reheating. A suitable reclaim valve is Model No. 3031RB12S7, made by Alco Controls.

A plurality of helix coils 56 are disposed at appropriate locations throughout the heat transfer system 10. Each helix coil 56 serves as the heat transfer point between the heat transfer medium and the water that is to be heated by heat transfer or exchange of the heat values from the heat transfer medium to the water. Each helix coil 56 can be any conventional helix heat transfer coil, such as Model No. S4, produced by Edwards Engineering Corp. 101 Alexander Ave. Pompton Plains, N.J. 07444. Once the heat values from the heat transfer medium are transferred to the water by use of the helix coil 56, the heated water can then be used in any of the various appurtenant uses provided in the heat transfer system 10.

The operation of the heat transfer system 10 of the present invention is as follows. The system operation to be described is a unidirectional flow, closed loop system that really does not have a beginning point and an ending point, but rather operates continuously in a steady state manner. However, to describe the operation of the system it is necessary to pick a point along the system and describe how the system operates from that point, but it is important to remember that the system does not actually start or stop at any particular point.

Spent or cooled heat transfer medium (i.e., heat transfer medium that has given up its heat values to water at one of the helix coils throughout the system), in a warm liquid form, is transferred from the receiver 40 through the filter drier 42 and is sent to a reclaim valve 50D where the heat transfer medium is directed into the environmental panels 20. The heat transfer medium flows through the first inlet expansion valve 25 into the first group on environmental panels 20B and additionally through the second inlet valve 24 as regulated by the solenoid valve 26 into the second group of environmental panels 20A if maximum heat values are required by the system. When the heat transfer medium passes through the expansion valves 24–25, the heat transfer medium undergoes a pressure drop which causes the heat transfer medium to begin to transform from a liquid into a gas. The heat transfer medium in its partially gaseous-liquid state then flows into the first group of environmental panels 20B, or both the first and second groups of environmental panels 20A or 20B, as the case may be. As the heat transfer medium passes through the environmental panels 20, the heat transfer medium absorbs heat from outside the building (ambient heat) which causes the heat transfer medium to increase in temperature. The now heated heat transfer medium is then transferred out of the environmental panels 20 through outlet lines 23 and is returned to the heat transfer medium handling station 30

At the heat transfer medium handling station 30, the now heated heat transfer medium is passed through a filter drier 32 and then into a series of accumulators 34. When the electrical control system (to be described in detail later) senses a need for heat values at one or more of the appurtenant uses in the heat transfer system 10, the compressor 38 is activated which causes the heat transfer medium to be compressed to the state of a superheated gas.

If heat values are needed to warm the non-potable water in the swimming pool 60 or in the jacuzzi 62, the heat transfer medium is sent from the compressor 38 and directed to a downstream helix coil 56A by means of a reclaim valve 50A. The transfer of the heat values from the heat transfer medium to the water to be used in the swimming pool 60 or the jacuzzi 62 occurs in the helix coil 56A. The heated water is sent by the water pump 54A either to the swimming pool 60 by means of opening water valve 52A and closing water valve 52AA or to the jacuzzi 62 by means of opening water valve 52AA and closing water valve 52A. After the heat transfer medium has transferred its heat to the water in the helix coil 56A, the heat transfer medium is recycled to the receiver 40 in the heat transfer medium handling station 30 for reheating.

If heat values are needed in the building to provide space heating to one or more rooms of the building, the heat transfer medium is sent from the compressor 38 through reclaim valve 50A and reclaim valve 50B and into a downstream helix coil 56B where heat values are transferred to non-potable water which is then used in a hydronic hose 64 which is disposed in the floors or walls of the rooms of the building. The hydronic hose 64 is any conventional hydronic hose assembly used for room space heating such as Model No. Twintran 5/8, produced by Twintran Corp., 3131 W. Chestnut Expressway, Springfield, Mo. 65802. The flow of the water through the hydronic hose 64 is effected by a water pump 54B and a water valve 52B. A plurality of hydronic hose loops may be used to alternatively heat various zones of the building. A plurality of water valves 52B may be connected to the water line to selectively direct the heated water to the particular hydronic hose loop desired to be used. After the heat values in the heat transfer medium have been transferred to the water at the helix coil 56B, the heat transfer medium is recycled back to the receiver 40 in the heat transfer medium handling station 30 for reheating.

If heat values are needed in the hot water heater 66 to provide hot potable water to one or more appurtenant uses of the building such as shower units, clothes washers or dishwashers, the heat transfer medium is sent from the compressor 38 through reclaim valve 50A and reclaim valve 50B and into a helix coil 56C where heat values are transferred to the potable water which is then used in a hot water heater 66. The hot water heater is any conventional hot water heater. The flow of the water through the hot water heater 66 is effected by a water pump 54C and a water valve 52C. Again, once the heating values in the heat transfer medium have been transferred to the water at the helix coil 56C, the heat transfer medium is recycled back to the receiver 40 in the heat transfer medium handling station 30 for reheating.

In addition to this transfer of heat for heating water in the hot water tank, the system of the present invention allows the heat values transferred to the hot water at helix coil 56C to also be used to heat air for heating the building. When the heated water leaving the helix coil 56C reaches valve 52C, the heated water can also be directed to one or more air handlers 70 which are located at appropriate locations in the air duct system of the building. Each separate zone of the building is heated by means of one of the air handlers 70. Suitable air handlers are Model No. RHQA1610B, made by Rheem Air Conditioning System, 5600 Old Green Wood Road, Fort Smith, Ark. 72903. In the air handler 70, air is blown over the pipes containing the heated water. The air is heated by transfer or exchange of the heat values in the water to the air being blown over the pipes and the heated air is then distributed by a conventional duct system throughout the building. The now cooled water is then recycled back to the helix coil 56C for reheating.

If the heat transfer system 10 has excess heat values that cannot be used in any of the appurtenant uses in the system, then the heat values in the heat transfer medium can simply be exhausted to the outside atmosphere. This is achieved by passing the heat transfer medium from the compressor 38 to the direct expansion condenser coil 80 located downstream from the compressor 38. The direct expansion condenser coil 80 can be any conventional direct expansion condenser coil such as Model No. CE 16-04-14-36, produced by Russell Coil Manufacturing, 3860 Arizona Avenue, Yuma, Ariz. 85365. The heat transfer medium is circulated through coils in the direct expansion condenser coil 80 while air is blown by a fan over these coils. The air is heated by heat transfer or exchange with the heat transfer medium and the hot air is exhausted to the outside atmosphere. The now cooled heat transfer medium is then returned to the receiver 40 for reheating.

Another feature of the present invention is that the air handlers 70 can also be used as a source of cool air that can be distributed throughout the building when it is desired to air condition the building such as during the warm summer months. In order to effect this cooling of the air going through the air handlers 70, it is only necessary that the heat transfer medium be cooled to a temperature low enough to be able to cool water to a lower temperature than the temperature of the air entering the air handlers so that the air in the air handlers can be cooled by coming into a heat transfer relation with the water entering the air handlers. The cooling of the heat transfer medium can be achieved as follows.

When the heat transfer medium leaves the compressor 38, it is in a superheated gaseous state having high heat values. Depending on the needs of the system, the heat transfer medium can be transferred to the first helix coil 56A for heating the swimming pool 60 or the spa 62. Alternatively, the heat transfer medium can be transferred to the second helix coil 56B to be used to supply heat values to the hydronic hose 64 for space heating the building—although if the heat transfer system 10 is being prepared to provide air conditioning through the air handlers 70, it is unlikely that building heating by way of the hydronic hose 64 would be required at the same time. Nevertheless, the system does permit hydronic heating of one part of the building while at the same time air cooling a different part or zone of the building, which may have application in certain situations. Alternatively, the heat transfer medium can be passed through the third helix coil 56C for heating water for the hot water tank 66. Alternatively, excess heat values in the heat transfer medium can be exhausted through the direct expansion condenser coil 80 to lower the temperature of the heat transfer medium to a suitable level to use it cool water which in turn is used to cool air to be passed through the air handlers 70 for air conditioning.

The spent or cooled heat transfer medium leaving the direct expansion condenser coil 80 is now in the liquid state and is returned to the receiver 40. When needed for air conditioning, the heat transfer medium is transferred from the receiver 40, through filter drier 42, through reclaim valve 50D and reclaim valve 50F, then directly into a fourth helix coil 56D. The heat transfer medium bypasses the environmental panels thereby eliminating the possibility that the ambient temperature would raise the temperature of the heat transfer medium and thus interfere with the efficiency of the cool heat transfer medium to be used to remove heat from the air inside the air handlers 70. In the fourth helix coil 56D, heat transfer between the heat transfer medium and water occurs, which lowers the temperature of the water and raises the temperature of the heat transfer medium. The now heated heat transfer medium is then recycled back to the heat transfer medium handling station 30.

The now cooled water from the fourth helix coil 56D is transferred through water valve 52F and water valve 52D into the air handlers 70. This water absorbs heat from air forced over the coil of the air handlers 70 by a blower inside the air handler 70. The air leaving the air handler 70 has been cooled permitting this air to be used to cool the building. The now heated water leaving the air handlers 70 is transferred by water valve 52E and water pump 54D back to the fourth helix coil 56D for recooling.

The selective operation of this integrated heat transfer system 10 allows the parts of the system to be activated as needed. In the winter, the environmental panels 20 are used to withdraw heat values from the outside atmosphere to heat water for the appurtenant uses of the building. During the summer, the heat transfer medium can be used to cool water which is then used in the air handlers 70 operating in the air conditioning mode. The heat taken out of the air in the air handlers can subsequently be used to heat the hot water tank, the swimming pool or the spa. It may not be necessary at all during the hot summer months to pass the heat transfer medium through the environmental panels since there may be enough heat values removed from the air during air conditioning to provide all the heat necessary for the other appurtenant uses.

FIGS. 2-6 show the control system of the present invention as an electrical schematic. The control system has been set for particular priorities based on the preferred embodiment, although other settings and priorities may be used and will be apparent to those skilled on the art. As used in the description of the schematic, the following terms have the meanings designated in Table I:

TABLE I

SC—Start Capacitor
T1 through T4—Transformers
TBC—Common Terminal Block
TB1 through TB8—High Voltage Terminal Blocks
P1 through P4—Pumps
R1 through R21—Relays
CR—Compressor Relay
SR—Start Relay
TD—Time Delay Relay
PS—Dual Pressure Switch
CH1—Compressor Crankcase Heater
CH2—Accumulator Crankcase Heater
RC1 through RC4—Run Capacitors
F1 through F5—Fast Acting Fuses
DP1 and DP2—PCB Dip Switches
PC1 through PC11—PC Board Mounted Terminal Blocks
SVC1 through SVC5—Solenoid Valves
WVM1 through WVM7—Water Diverting Valves
FM1 through FM3—Fan Motors
AQ1 through AQ5—Aquastats Temperature Sensors
S1 through S3—Lockout Switches
L1 through L3—Water Limit Temperature Thermostats
L4—Chilled Water Freeze Thermostat The control system of the present invention is used to operate the heat transfer system through the various modes available to heat or cool various parts of the building and the appurtenant uses associated therewith. In all of the various modes of the heat transfer system, high voltage power (240V AC) is connected from TB1 through F1, then through T1 to transform to the power to low voltage (24V AC), which most of the controls and sensors use as a power source, unless otherwise specified. The low voltage (24V AC) is then supplied to the limit thermostats L1, L2, L3 and L4, which are wired in series so that the circuit is completed from the limit thermostats to pin L and pin 24 of PC2. The limit thermostats L1, L2, L3 and L4 are each associated with one or more aquastat temperature sensors AQ1-AQ5 or conventional wall mounted thermostats. In the preferred embodiment, L1 is associated with AQ1, L2 is associated with AQ2 and AQ3, L3 is associated with AQ4 and AQ5 and L4 is associated with wall mounted thermostats.

Whenever the limit thermostats L1, L2, L3 or L4 cause interruption of the circuits, power is discontinued to the control circuit causing all functions to cease operation. All of the limits are of the manual reset type, so the cause of the interruption must be examined before continued operation of the equipment.

The other leg of power (24V AC) "common" is wired to the common terminal block TBC through F2.

Due to the method of the wiring design, when all sensors are satisfied, only minimal power loss is incurred through the transformers of the system and the crankcase heaters, the requirement of minimum power loss being a standard in the industry. The sensors also cause no power loss.

The printed circuit board mounted terminal blocks, PC1 through PC11, control the operation of the various elements of the heat transfer system in response to conditions sensed by the aquastat temperature sensors, AQ1 through AQ5. The operation of the aquastat temperature sensors will cause various pins on the printed circuit board mounted terminal blocks to be energized.

Beginning first with PC1, whenever pin 0 of PC1 is energized, the following occurs: pin 0 of PC1 energizes the time delay circuit of TD. If the power has been discontinued from TD for the preset time delay interval, power is supplied to the coil of CR1 through the normally closed contacts of PS causing the coil of CR1 to become energized, thereby closing the normally open contacts of the CR1. If power has not been discontinued to TD for the preset time interval, the TD then will not supply power to the coil of CR1 until the preset interval is attained. The common side of the coil of CR1 and TD are wired to TBC. Power (240V AC) is supplied to the compressor 38 from TB1 through the contacts of CR1 and through the start components SR, RC1 and SC1. When this circuit is completed, the compressor 38 will operate.

Whenever pin 6 of PC1 is energized, the following occurs: pin 6 of PC1 energizes the coil of R18 causing the normally open contacts to close. Power (usually 240V AC in the preferred embodiment, but alternatively 117 V AC depending on the application) is provided to P1 from TB7 through R18. When the contacts of R18 close, power is supplied to P1 causing it to operate. The common side of the coil of R18 is wired to TBC.

Whenever pin 7 of PC1 is energized, the following occurs: pin 7 of PC1 energizes the motor of valve 52C causing it to operate. Pin 7 of PC1 is also wired to pin M7 of PC7. Pin M7 of PC7 is connected to the coil of R13. The common side of the coil of R13 is connected to pin MC of PC7, then to TBC. If there is more than one zone installed (as will be explained in detail below), pin 7 of PC1 is also connected to pin M7 of the other zone's PC board, shown here as pin M7 of PC9. The internal wiring of the PC boards for each of the zones is identical, only the external wiring is different. Whenever more than one zone is being used, pin MC of PC9 is wired to pin Z2 of the priority zone (in this case the first zone), shown here as pin Z2 of PC6.

Whenever pin 8 of PC1 is energized, the following occurs: pin 8 of PC1 energizes the coil SVC3. The common side of this coil is wired to TBC.

Whenever pin 9 of PC1 is energized, the following occurs: pin 9 of PC1 energizes the coil of R15 through the normally closed contacts of R16. The common side of the coil of R15 is wired to TBC. Pin 9 of PC1 is also wired to pin 9 of PC5, and SVC6. The other side of the coil of SVC6 is wired to TBC.

Whenever pin 10 of PC1 is energized, the following occurs: pin 10 of PC1 energizes the coil of R19. The common side of R19 is wired to TBC.

Referring next to PC2, pin B and pin C of PC2 are not being used in this preferred embodiment. Whenever pin 1 of PC2 closes contact to TBC through a sensor, the following occurs: pin 1 of PC2 will cause the coil of R1 to become energized if a connection is being made from the other side of the coil R1 to pin L of PC2.

Whenever pin 2 of PC2 closes contact to TBC through a sensor, the following occurs: pin 2 of PC2 will cause the coil of R2 to become energized if a connection is being made from the other side of the coil R2 to pin L of PC2.

Whenever pin 3 of PC2 closes contact to TBC through a sensor, the following occurs: pin 3 of PC2 will cause the coil of R3 to become energized if a connection is being made from the other side of the coil R3 to pin L of PC2.

Whenever pin 4 of PC2 closes contact to TB through a sensor, the following occurs: pin 4 of PC2 will cause the coil of R4 to become energized if a connection is being made from the other side of the coil R4 to pin L of PC2.

Whenever pin 5 of PC2 closes contact to TBC through a sensor, the following occurs: pin 5 of PC2 will cause the coil of R5 to become energized if a connection is being made from the other side of the coil R5 to pin L of PC2.

Referring next to PC3, pin 11, pin 12, pin 14 and pin 16 are not being used in this preferred embodiment. Whenever pin 13 of PC3 is energized, the following occurs: pin 13 of PC3 energizes the coil of R14. The common side of the coil is connected to TBC.

Whenever pin 15 of PC3 is energized, the following occurs: pin 15 of PC3 energizes the coil of SVC2, and through a contact of AQ5, energizes the coil of valve 52B. The common side of the coil of SVC5 and the motor of valve 52B are connected to TBC.

The circuits of the common sides of the coils referred to above, can be broken in numerous ways, and at different times in the various modes.

Referring now to PC4 and PC5, power (preferably 250 V AC in the preferred embodiment, although 117 V AC may be used depending on the application), is supplied from TB3 to T2. Pin 24 of PC4 is wired to T2 through F3, and pin COM of PC4 is also wired to the other side of T2. This circuit supplies the power (24V AC) to the PC Board Mounted Terminal Block PC4 to be used by relays R6 and R7 and sensors AQ2 and AQ3 for the operation of the condensing section. Pin 3 of PC4 is not used in this preferred embodiment but is internally connected to pin 2 and pin 1 of PC4.

Whenever pin 2 of PC4 is energized, the following occurs: pin 2 of PC4 energizes the coil of valve 52A causing it to open. The common side of the coil is connected to the common side of T2 or pin COM of either PC4 or PC5.

Whenever pin 1 of PC4 is energized, the following occurs: pin 1 of PC4 energizes the coil of valve 52AA causing it to open. The common side of the coil is connected to the common side of T2 or pin COM of either PC4 or PC5.

Whenever pin 7 of PC5 closes contact with pin COM of PC5 through AQ3 and S2, the following occurs: pin 7 of PC5 will energize the coil of R6 if a closed circuit is being made between the other side of the coil and pin 24 of PC4.

Whenever pin 6 of PC5 closes contact with pin COM of PC through AQ2 and S1, the following occurs: pin 6 of PC5 will energize the coil of R7 if a closed circuit is being made between the other side of the coil and pin 24 of PC4.

Pin 4 of PC5 is connected to pin C of PC5 through contacts in R6 and R7. Pin 4 of PC5 is also wired to pin 4 of PC2 through S3. Pin C of PC5 is wired to TBC. This allows the manual breaking of the completed sensor circuit between pin 4 of PC2 and TBC because of the manual accessibility to S3.

Pin 9 of PC5 is connected to pin X of PC5 through contacts in R6 and R7. Pin 9 of PC5 is also wired to pin 9 of PC1. Whenever a circuit is completed between pin 9 of PC1 and pin X of PC5 through pin 9 of PC5 and the contacts of R6 and R7, and pin 9 of PC1 is energized, then pin X of PC5 will also become energized. Pin X of PC5 also then energizes the coil of R16. The other side of the coil of R16 is wired to TBC.

Referring now to PC6, PC7 and PC8, power (preferably 250 V AC in the preferred embodiment, although 117 V AC may be used depending on the application) is supplied through TB6 to T4. Pin R of PC8 is wired to T4 through F5 and pin C of PC8 is also wired to the common side of T4. This circuit supplies the power (24V AC) to the PC Board Mounted Terminal Block PC8 to be used by relays R11, R12, R13, R20, and the wall mounted thermostat wired to PC8, for the operation of zone 1.

Pin V3 of PC6 is not used in this embodiment if this PC Board is to be zone 1. It is connected to pin R of PC8 through contact B of R11. Pin C2 of PC7 is not used in this embodiment if this PC Board is to be zone 1. It is connected to pin M3 of PC7 through contact B of R12.

Whenever pin W of PC8 is energized, the following occurs: pin W of PC8 energizes the coil of R11. The common side of the coil of R11 is connected to pin C of PC8.

Whenever pin Y of PC8 is energized, the following occurs: pin Y of PC8 energizes the coil of R12. The common side of the coil of R12 is connected to pin C of PC8.

Whenever pin G of PC8 is energized, the following occurs: pin G of PC8 energizes pin FR of PC8 through either the contact D of R12 or contact E of R13.

Whenever pin FR of PC8 is energized, the following occurs: pin FR of PC8 energizes the coil of R20. The common side of the coil of R20 is connected to pin C of PC8.

Pin MC of PC7 is connected to TBC. Pin M2 of PC7 is connected to pin 2 of PC2. Pin M7 of PC7 is connected to pin 7 of PC1. Pin M3 of PC7 is connected to pin 3 of PC2. Pin R3 of PC7 is connected to the coil of R21. The common side of the coil of R21 is connected to pin C of PC6. Pin C of PC7 is also internally connected to pin C of PC8.

Pin Z2 of PC6 is connected to pin MC of PC9 of the PC Board Mount Terminal Blocks PC9 of zone 2. This wire is the heat prioritizing wire between zone 1 and zone 2. Pin Z2 of PC10 of zone 2 would then be connected to pin MC of the following zone 3 if three zones were to be installed.

Pin R of PC6 is internally connected to pin R of PC8. Pin C of PC6 is internally connected to pin C of PC8.

Referring now to PC9, PC10 and PC11, power (preferably 250 V AC in the preferred embodiment, although 117 V AC may be used depending on the application) is supplied through TB5 to T3. Pin R of PC11 is wired to T3 through F4, and pin C of PC11 is also wired to the common side of T3. This circuit supplies the power (24V AC) to the PC Board Mounted Terminal Block PC11 to be used by relays R8, R9, R10, R17, the motor of water valve 52D and the coil of solenoid valve 58 as well as the wall mounted thermostat wired to PC11 for the operation of zone 2. Pin Z2 of PC10 is not used because this is to be zone 2.

Whenever pin W of PC11 is energized, the following occurs: pin W of PC11 energizes the coil of R8. The common side of R8 is connected to pin C of PC11.

Whenever pin Y of PC11 is energized, the following occurs: pin Y of PC11 energizes the coil of R9. The common side of R9 is connected to pin C of PC11.

Whenever pin G of PC11 is energized, the following occurs: pin G of PC11 energizes pin FR of PC11 through either contact D of R9 or contact E of R10.

Whenever pin FR of PC11 is energized, the following occurs: pin FR of PC11 energizes the coil of R17. The common side of the coil of R17 is connected to pin C of PC11.

Pin C2 of PC9 is connected to pin MC of PC7 of zone 1 and TBC through the normally open contacts of R21. Pin MC of PC9 is connected to pin Z2 of PC6 of zone 1. Pin M2 of PC9 is connected to pin 2 of PC2. Pin M7 of PC9 is connected to pin 7 of PC1. Pin M3 of PC9 is connected to pin 3 of PC2.

Whenever pin R3 of PC9 is energized, the following occurs: pin R3 of PC9 energizes the coil of solenoid valve 58. The common side of the coil is connected to pin C of PC9.

Whenever pin V3 of PC6 is energized, the following occurs: pin V3 of PC6 energizes the motor of water valve 52D. The common side of the motor is connected to pin C of PC6. Pin R of PC10 is internally connected to pin R of PC11.

The operation of the various modes of the present invention will now be described with reference to the schematic shown in FIGS. 2–6.

Mode 1: Heating domestic hot water in the hot water heater 90.

Taking into consideration that all limit switches are closed, when the contacts of AQ1 close, the following occurs: a closed circuit is incurred between TBC and pin 1 of PC2 energizing R1. The common circuit of R1 is connected to the coil of R1 through contact 1 of DP1 which is connected to pin L.

When R1 is energized, the normally open contacts contained in R1 close, energizing pin 0 of PC1 and pin 6 of PC1. The normally closed contacts of R1 then open, interrupting the closed circuits of contacts of R5, R2, and contact 2 of DP1. Contacts 1, 2, 3 and 4 of DP1 determine which mode of heating is completed first. The contacts 1, 2, 3 and 4 of DP1 are those contacts shown in the drawing and are identified in the conventional manner reading from left to right. DP1 is set at the time of installation, depending on the user's preference, and can be changed at any time to a different setting.

Pin 0 of PC1 then energizes the compressor circuit causing the compressor 38 to operate, if all of the compressor operating conditions ar satisfied. Pin 6 of PC1 then energizes the coil of R18 causing the pump 54C to operate.

Mode 2*a:* Heating space zone 1 (air in rooms) using air handler 70.

This mode is exercised in accordance with the priority determined by the setting of DP1. A closed circuit is made between pin 2 of PC2 and TBC by means of a thermostat connected to pins R and W of PC8 through R11 and pin M2 of PC7. Pins 0, 6 and 7 of PC1 are energized which causes the compressor 38 to operate, R18 to become energized thereby causing the pump 54C to operate, also causing the motor of water valve 52C to operate and also energizing pin M7 of PC7.

Mode 2*b:* Heating space zone 2 (air in rooms) using air handlers 70.

This mode is exercised in accordance with the priority determined by the setting of DP1 and whether or not the thermostat of zone 1 is satisfied. A closed circuit is made between pin 2 of PC2 and TBC by means of a thermostat connected to pins R and W of PC11 through R8 and pin M2 of PC9. Pins 0, 6 and 7 of PC1 are energized which causes the compressor 38 to operate, R18 to become energized thereby causing the pump 54C to operate and causing the motor of water valve 52C to operate. This also energizes both pin M7 of PC9 and pin V3 of PC10 causing the motor of water valve 52D to operate.

Mode 3: Heating a swimming pool 60.

This mode may be exercised only if switch S3 is closed and modes 1 and 2 are satisfied or when the cooling mode is being utilized. (The cooling mode will be explained more fully herein.)

A closed circuit is made between pin 4 of PC and TBC by means of a temperature sensor connected to pin 6 and pin COM of PC5 through R7, pin 4 of PC5 and switch S3. Pins 0 and 9 of PC1 are energized Which causes the compressor 38 to operate, R15 to become energized thereby causing the pump 54A to operate and solenoid reclaim valve 50A to become energized.

Mode 4: Heating a spa 62.

This mode may exercised only if switch S3 is closed and modes 1 and 2 are satisfied, or when the cooling mode is being utilized.

A closed circuit is made between pin 4 of PC2 and TBC by means of a temperature sensor connected to pins 7 and COM of PC5 through R6, pin 4 of PC5 and switch S3. Pins 0 and 9 of PC1 and pins 1 and 2 of PC4 are energized which causes the compressor 38 to operate, R15 to become energized thereby causing the pump 54A to operate, and both of the water valves 52A and 52AA to operate. This also causes solenoid reclaim valve 50A to become energized.

Mode *5a:* Hydronic floor heating zone 1 using hydronic hoses 64.

This mode is exercised only after all other modes of heating are satisfied. A closed circuit is made between pin 5 of PC2 and TBC by means of a temperature sensor AQ4. This can also be a wall mounted type thermostat including cooling through one of the heating/cooling zones. Pin 13 of PC3 then becomes energized and is connected to the coil of R14. The normally open contacts of R14 then close causing the pump 54B to operate. Pin 15 energizes the coil of solenoid reclaim valve 50B causing it to operate.

Mode *5b:* Hydronic floor heating zone 2 using hydronic hose 64.

This mode is exercised only after all other modes of heating are satisfied including hydronic floor heating zone A closed circuit is made between pin 5 of PC2 and TBC by AQ5 through a normally closed set of contacts in AQ4. Pin 13 of PC3 then energizes the coil of R14 causing the pump 54B to operate. Pin 15 of PC3 energizes the coil of solenoid reclaim valve 50B and through a set of normally open contacts (closed when AQ5 calls for heat) energizes water valve 52B.

Mode 6: chilling water.

This mode is used in place of the air conditioning mode in zones 1 and 2 using the air handlers 70. It is designed for cold water storage. A closed circuit is made between pin 3 of PC2 and TBC through a wall mounted thermostat (zone 1 or 2) or an aquastat. In the preferred embodiment illustrated, it is controlled by the wall mounted thermostat of zones 1 and 2. When pin 3 of PC2 is energized, pins 0, 8, 9 and 10 of PC1 are energized. Pin 0 of PC2 then energizes the compressor circuit causing the compressor 38 to operate. Pin 8 of PC2 energizes the coil of solenoid reclaim valve 50D causing it to operate. Pin 9 of PC1 energizes pin 9 of PC5 and, through the selection of the control PC Board, a determination is made as to the best possible use of the waste heat. Either heating the pool 60 or spa 62, or as a last resort utilizing the direct expansion condenser fan 80. The priority is first given to heat the domestic hot water in the hot water heater 90.

Mode *7a:* Air conditioning zone 1 (air in rooms).

A closed circuit is made between pin R of PC8 and pin Y of PC8 through a wall mounted thermostat. When pin Y of PC8 is energized, R12 is energized. Pin FR of PC8 is energized. This in turn causes R20 to close, causing the fan motor FM2 in the first air handler 70A to operate. Pin 0 of PC1 is energized causing the compressor circuit to effect the compressor 38 to operate. Pin 9 of PC1 energizes pin 9 of PC5 and, through the selection of the control PC Board, a determination is made as to the best possible use of the waste heat. Either heating the pool 60 or spa 62 or, as a last resort, utilizing the condenser fan coil 80. The priority is first given to heat the domestic hot water 90.

Pin 9 of PC1 also energizes the coil of the solenoid reclaim valve 50A causing the solenoid valve 50D to change from the environmental panels 20 to the direct expansion evaporator coil in the air handler 70A of zone 1.

Mode *7b:* Air conditioning zone 2 (air in rooms).

This mode is exercised only when zone 1 air conditioning has been satisfied. In the preferred embodiment, zones 1 and 2 cannot both be operated at the same time. A closed circuit is made between pin R of PC11 and pin Y of PC11 through a wall mounted thermostat. When pin Y of PC11 is energized, the coil of R9 is energized. Through pin FR of PC11, the coil of R17 is energized causing the fan motor FM3 to operate in the air handler 70B of zone 2. Pin 0 of PC1 is energized causing the compressor circuit to effect compressor 38 to operate. Pin 9 of PC1 energizes pin 9 of PC5. Through the selection of the control PC Board circuit, a determination is made as to the best possible use of the waste heat. Either heating the pool 60 or the spa 62 or, as a last resort, utilizing the direct expansion condenser fan coil 80. The priority is first given to heating the domestic hot water 90.

Pin 9 of PC1 also energizes the coil of the solenoid reclaim valve 50A causing the solenoid valve 50D to change from the environmental panels 20 to the direct expansion coil of the zone 2 air handler 70B, through the solenoid valve 50E which is energized by pin R3 of PC9. The solenoid valve 50D is changed from the direct expansion coil of zone 1 to the direct expansion coil of zone 2.

Figure 2:
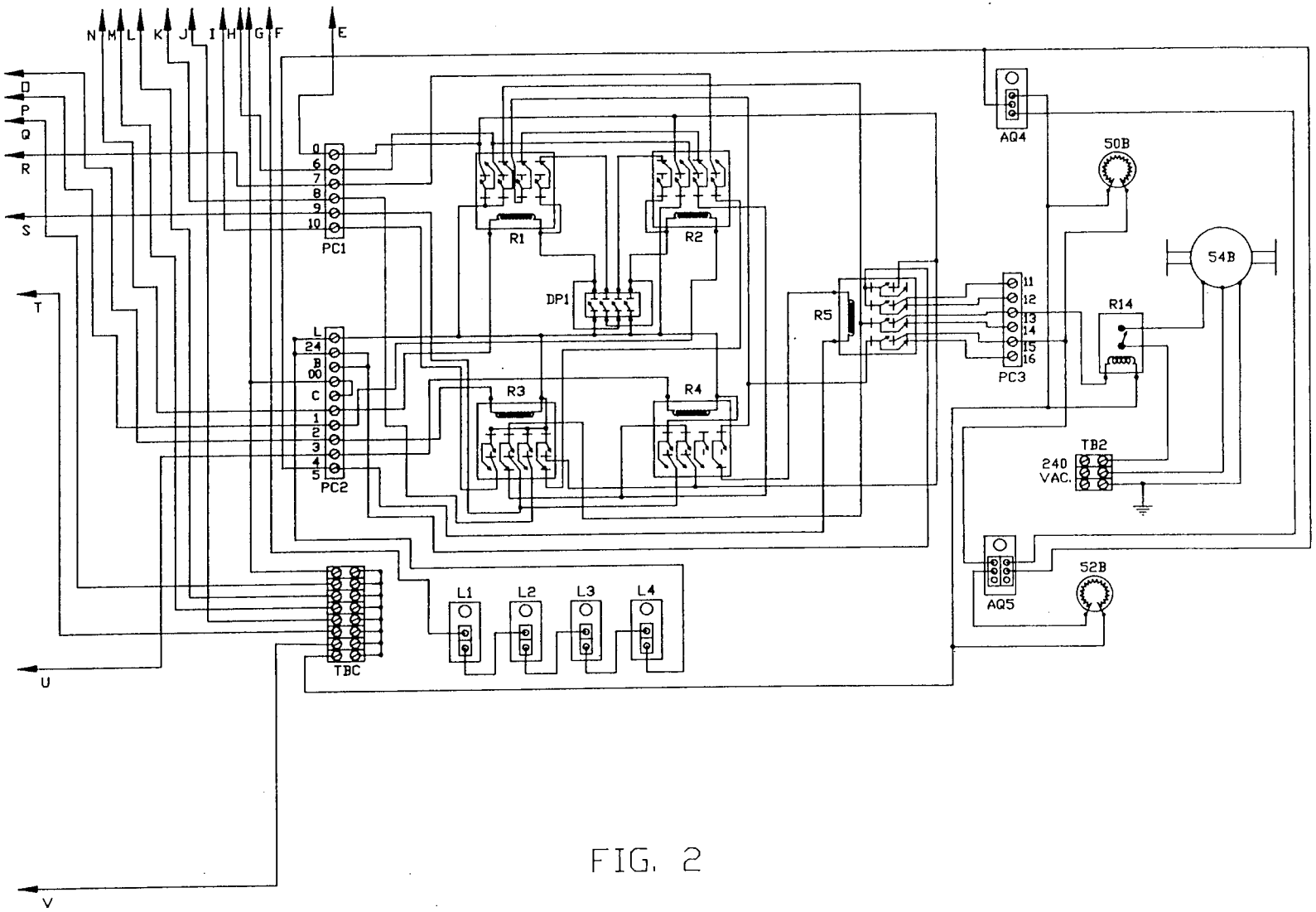
FIG. 2 shows schematically a portion of the electrical control system used to operate the heat transfer system of the present invention.
Figure 3:
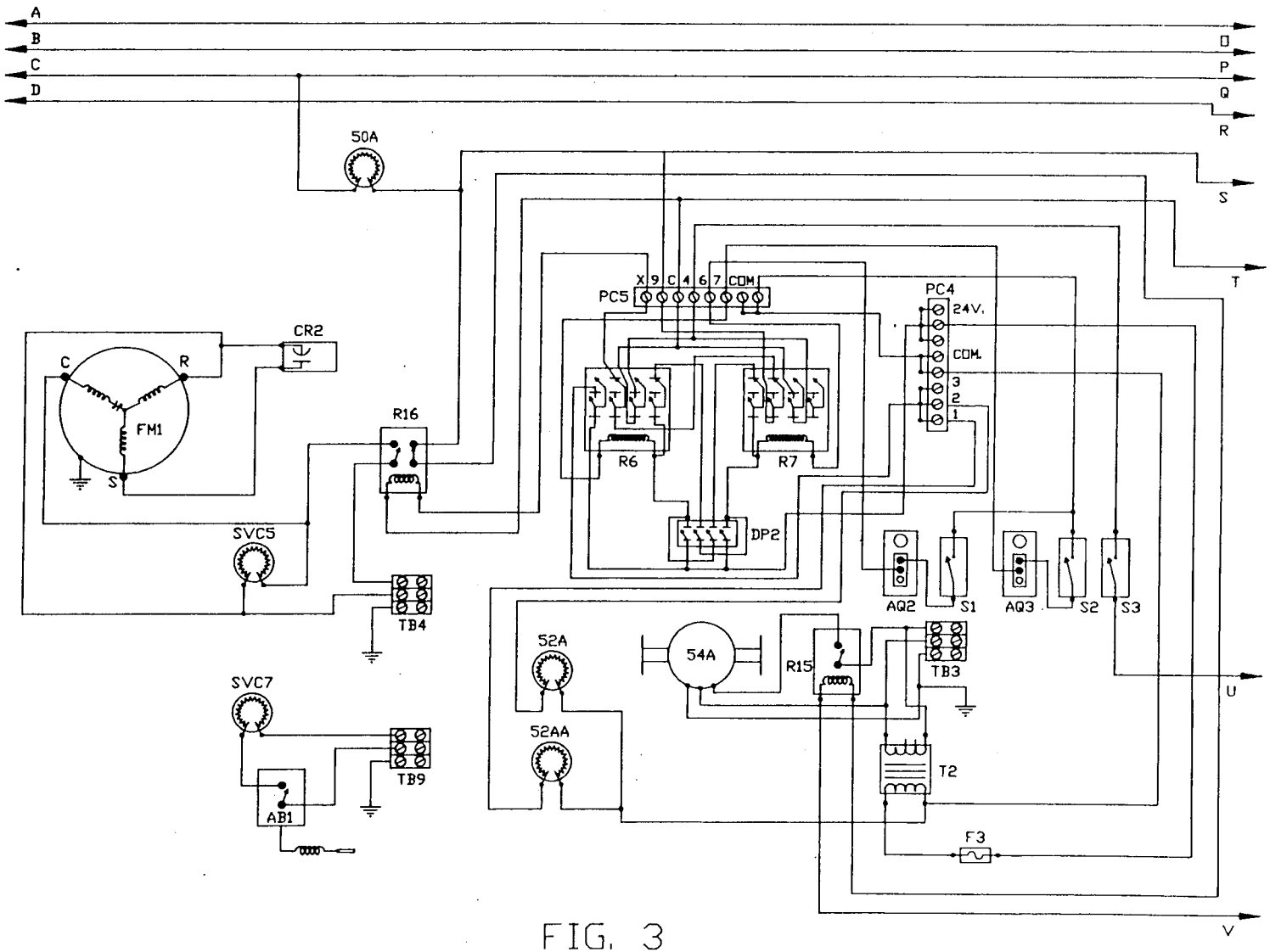
FIG. 3 shows schematically another portion of the electrical control system used to operate the heat transfer system of the present invention.
Figure 4:
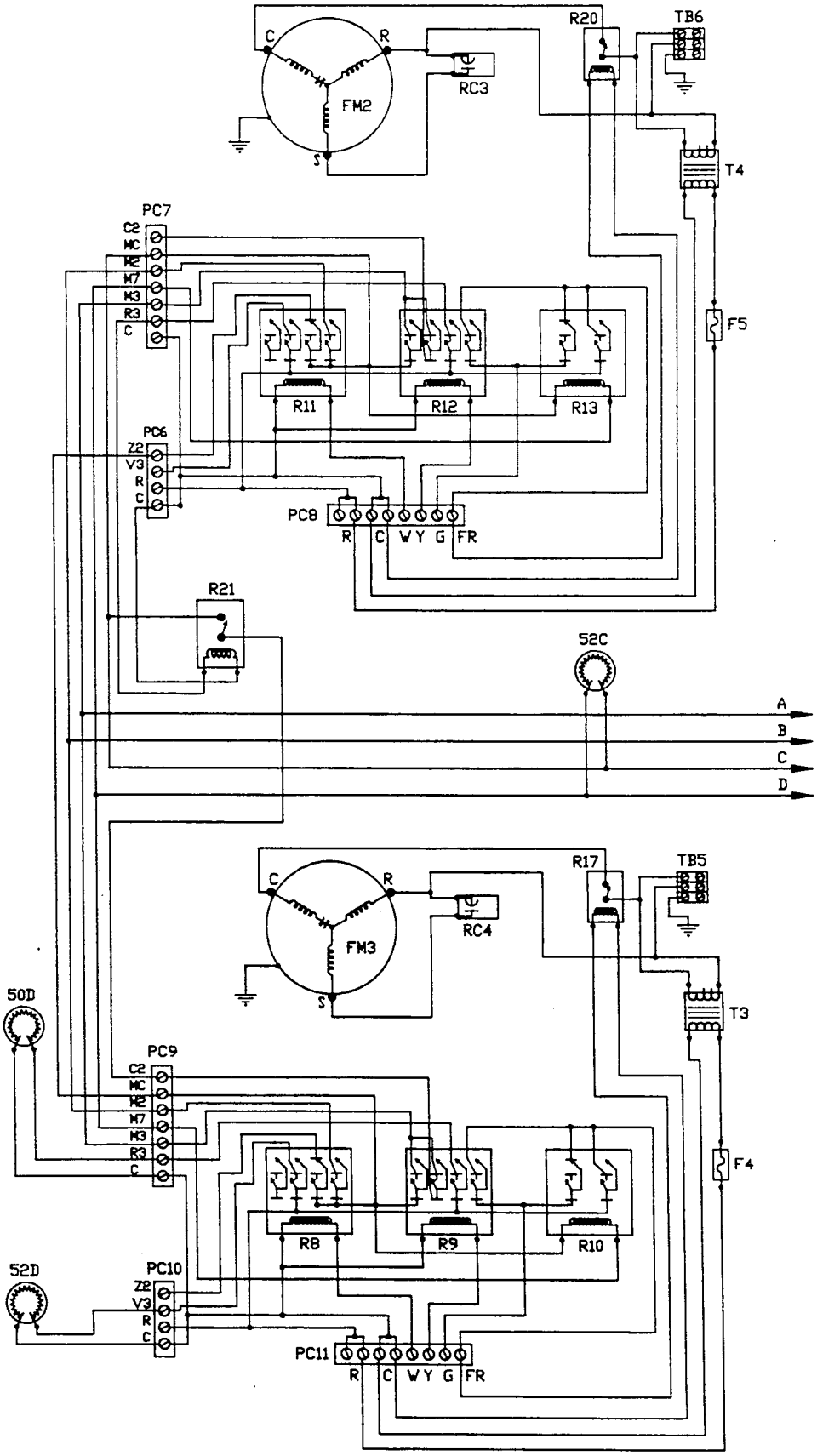
FIG. 4 shows schematically another portion of the electrical control system used to operate the heat transfer system of the present invention.
Figure 5:
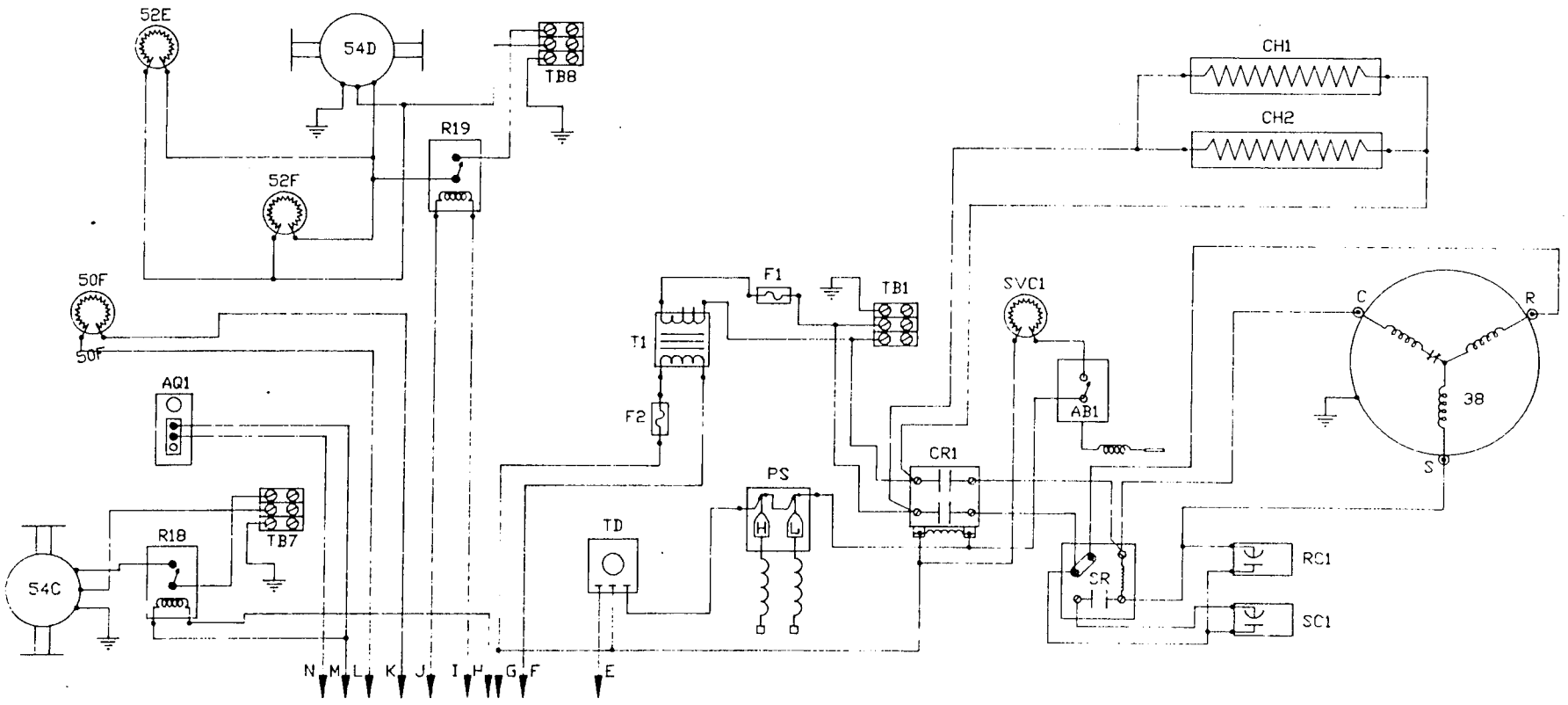
FIG. 5 shows schematically another portion of the electrical control system used to operate the heat transfer system of the present invention.
Figure 6:
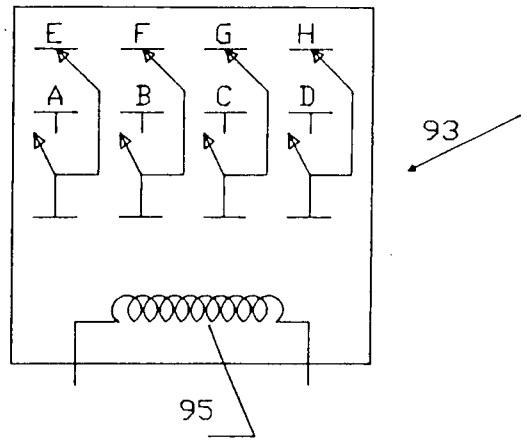
FIG. 6 shows schematically a four pole double throw relay used in the electrical control system of the present invention.

FIG. 5 shows a typical four pole double throw relay 93 that is used in the present invention. Each relay has four stationary contacts A, B, C and D and four moving contacts E, F, G and H. A coil 95 is also provided in each relay. Many of the relays shown in the schematic FIGS. 2–4 are four pole double throw relays 93 as shown in FIG. 5 although some of the relays as illustrated are only one pole or two pole relays.

The operation of each of the relays R1–R21 will now be described.

When R1 is energized, the following occurs:

Contact A completes the circuit between pin 0 of PC1 and pin 1 of PC2. Contact B completes the circuit between pin 6 of PC1 and pin L of PC2. Contact C is not used. Contact D is not used. Contact E is not used. Contact F breaks the circuit between the coil of R5 and pin L of PC2, through contacts G of R3, G of R2, G of R1 and E of R4, disabling the use of R5. Contact H breaks the circuit between the coil of R2 and pin L of PC2, through contact 1 of DP1, contact H of R1 and contact 2 of DP1, depending on the preset preference.

When R2 is energized, the following occurs:

Contact A is not used. Contact B completes the circuit between pin 0 of PC1 and pin L of PC2. Contact C completes the circuit between pin 6 of PC1 and pin L of PC2, through contacts F of R1 and G of R3. If R1 or R3 is energized, pin 6 of PC1 is disabled. Contact D completes the circuit between pin 7 of PC1 and pin L of PC2 through contact H of R3. If R3 is energized, pin 7 of PC1 is disabled. Contact E breaks the circuit between the coil of R1 and pin L of PC2 through contact 4 of DP1, contact E of R2 and contact 3 of DP1, depending on the preset preference. Contact F is not used. Contact G breaks the circuit between the coil of R5 and pin L of PC2, through contacts G of R3, G of R2, G of R1 and E of R4, which disables the use of R5. Contact H is not used.

When R3 is energized, the following occurs:

Contact A completes the circuit between pin 0 of PC1 and pin L of PC2. Contact B completes the circuit between pin 8 of PC1 and pin L of PC2. Contact C completes the circuit between pin 9 of PC1 and pin L of PC2 through contact F of R1. If R1 is energized, pin 9 of PC1 is disabled. Contact D completes the circuit between pin 10 of PC1 and pin L of PC2. Contact E breaks the circuit between pin 7 of PC1 and pin L of PC2 through contact D of R2 only if R2 is energized, otherwise the circuit is already broken if R2 is not energized. Contact F is not used. Contact G breaks the circuit between pin 6 of PC1 and pin L of PC2 and between the coil of R5 and pin L of PC2 through contacts G of R2, G of R1, F of R4 and F of R1. If R1, R2, or R4 are energized, pin 6 of PC1 stays active. If R4 is energized, then R5 is disabled. Contact H is not used.

When R4 is energized, the following occurs:

Contact A is not used. Contact B is not used. Contact C completes the circuit between pin 0 of PC1 and pin L of PC2 through contact F of R1 only if R1 is not energized, or contact C completes the circuit between pin 0 of PC1 and pin L of PC2 through contact G of R3 if R3 is not energized. Contact D completes the circuit between pin 9 of PC1 and pin L of PC2. Contact E breaks the circuit between the coil of R5 and pin L of PC2 through contacts G of R1, G of R2, G of R3 and F of R1. If R1, R2, R3 or R4 are energized, then R5 is disabled. Contact F is not used. Contact G is not used. Contact H is not used.

When R5 is energized, the following occurs:

Contact A completes the circuit between pin 0 of PC1 and pin 24 of PC2. Contact B completes the circuit between pin 11 of PC3 and pin 24 of PC2. Contact C completes the circuit between pin 13 of PC3 and pin L of PC2 through contact F of R1. If R1 is energized, then pin 13 of PC3 is disabled. Contact D completes the circuit between pin 15 of PC3 and pin L of PC2 through contacts G of R1, G of R2, G of R3 and F of R1. If R1, R2 or R3 are energized, pin 15 of PC3 is disabled. Contact E is not used. Contact F breaks the circuit between pin 12 of PC3 and pin 24 of PC2. Contact G breaks the circuit between pin 14 of PC3 and pin L of PC2 through contact F of R1. If R1 is energized, pin 14 of PC3 is disabled. Contact H breaks the circuit between pin 16 of PC3 and pin L of PC2 through contacts G of R1, G of R2, G of R3 and F of R1. If R1, R2 or R3 are energized, then pin 16 of PC3 is disabled.

When R6 is energized, the following occurs:

Contact A completes the circuit between pin 24 V of PC4 and pins 1, 2 and 3 of PC4. Contact B is not used. Contact C completes the circuit between pin 4 of PC5 and pin C of PC5. Contact D is not used. Contact E is not used. Contact F breaks the circuit between pin X of PC5 and pin 9 of PC5 through contact F of R7. Contact G is not used. Contact H breaks the circuit between pin 24 V of PC4 and the coil of R7 through contacts 1 and 2 of DP2.

When R7 is energized, the following occurs:

Contact A is not used. Contact B is not used. Contact C completes the circuit between pin 4 of PC5 and pin C of PC5. Contact D is not used. Contact E breaks the circuit between pin 24V of PC4 and the coil of R6 through contacts 3 and 4 of DP2. Contact F breaks the circuit between pin 9 of PC4 and pin X of PC4 through contact F of R6. Contact G is not used. Contact H is not used.

When R8 is energized, the following occurs:

Contact A is not used. Contact B completes the circuit between pin R of PC11 and pin VR3 of PC10. Contact C is not used. Contact D completes the circuit between pin MC of PC9 and pin M2 of PC9. Contact E is not used. Contact F is not used. Contact G breaks the circuit between pin MC of PC9 and pin Z2 of PC10. Contact H is not used.

When R9 is energized, the following occurs:

Contact A completes the circuit between pin MC of PC9 and pin M2 of PC9. Contact B completes the circuit between pin M3 of PC9 and pin C2 of PC9. Contact C completes the circuit between pin R3 of PC9 and pin R of PC11. Contact D completes the circuit between pin G of PC11 and pin FR of PC11. Contact E is not used. Contact F is not used. Contact G is not used. Contact H is not used.

When R10 is energized, the following occurs:

Contact A is not used. Contact B completes the circuit between pin R of PC11 and pin FR of PC11. Contact C is not used. Contact D is not used. Contact E breaks the circuit between pin G of PC11 and pin FR of PC11. Contact F is not used. Contact G is not used. Contact H is not used.

When R11 is energized, the following occurs:

Contact A is not used. Contact B completes the circuit between pin R of PC8 and pin V3 of PC6. Contact C is not used. Contact D completes the circuit between pin MC of PC7 and pin M2 of PC7. Contact E is not used. Contact F is not used. Contact G breaks the circuit between pin MC of PC7 and pin Z2 of PC6. Contact H is not used.

When R12 is energized, the following occurs:

Contact A completes the circuit between pin MC of PC7 and pin M2 of PC7. Contact B completes the circuit between pin M3 of PC7 and pin C2 of PC7. Contact C completes the circuit between pin R3 of PC7 and pin R of PC8. Contact D completes the circuit between pin G of PC8 and pin FR of PC8. Contact E is not used. Contact F is not used. Contact G is not used. Contact H is not used.

When R13 is energized, the following occurs:

Contact A is not used. Contact B completes the circuit between pin R of PC8 and pin FR of PC8. Contact C is not used. Contact D is not used. Contact E breaks the circuit between pin G of PC8 and pin FR of PC8. Contact F is not used. Contact G is not used. Contact H is not used.

When R14 is energized, the following occurs:

The normally open contact closes completing a circuit between TB2 and 54B causing the pump 54B to operate.

When R15 is energized, the following occurs:

The normally open contact closes completing a circuit between TB3 and 54A causing the pump 54A to operate.

When R16 is energized, the following occurs:

The normally open contact (shown as open in the drawing) closes completing a circuit between TB4 and FM1 causing the fan motor FM1 to operate. The normally closed contact (shown as closed in the drawing) opens, breaking the circuit between pin 9 of PC1 and the coil of R15. The other side of the coil of R15 is wired to TBC.

When R17 is energized, the following occurs:

The normally open contact closes completing a circuit between TB5 and FM3 causing the fan motor FM3 to operate.

When R18 is energized, the following occurs:

The normally open contact closes completing a circuit between TB7 and 54C causing the pump 54C to operate.

When R19 is energized, the following occurs:

The normally open contact closes completing a circuit between TB8 and 54D, 52E and 52F causing the pump 54D, the water valve motor 52E and the water valve motor 52F all to operate.

When R20 is energized, the following occurs:

The normally open contact closes completing a circuit between TB6 and FM2 causing the fan motor FM2 to operate.

When R21 is energized, the following occurs:

The normally open contact closes completing a circuit between pin C2 of PC9 of zone 2 and TBC.

In the preferred embodiment of the present invention, the heat transfer medium is Refrigerant 12. The potable water in the hot water heater is preferably maintained at a temperature of approximately 120° F. and the hot water being added to the swimming pool or the jacuzzi is heated to a temperature of approximately 140°0 F.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A heat transfer system comprising:

a) a series of environmental panels for supplying heat values from the ambient atmosphere to a heat transfer medium circulated within the panels, b) a heat transfer medium handling station downstream of the environmental panels having an accumulator and a compressor joined together in fluid communication, c) a first helix coil downstream of the compressor for transferring heat values from the heat transfer medium to water for use in heating a swimming pool, d) a second helix coil downstream of the compressor for transferring heat values from the heat transfer medium to water for use in a hydronic hose for heating the floors of a building, e) a third helix coil downstream of the compressor for transferring heat values from the heat transfer medium to water for use in a hot water tank and for use in an air handler, f) an air handler downstream of the third helix coil for transferring heat values from the water to air for heating a building, and g) a receiver downstream of the helix coils for receiving the heat transfer medium after the heat values have been transferred therefrom.

2. The heat transfer system of claim 1 wherein a first inlet line is connected to a first group of the environmental panels and a second inlet line is connected to a second group of the environmental panels so that the heat transfer medium can be selectively circulated through either the first group, second group or both groups of panels.

3. The heat transfer system of claim 2 wherein the environmental panels are arranged in a row with a panel from the first group alternating with a panel from the second group.

4. The heat transfer system of claim 1 wherein the accumulator is located downstream of the environmental panels and upstream of the compressor.

5. The heat transfer system of claim 4 wherein more than one accumulator is located in the heat transfer medium handling station.

6. The heat transfer system of claim 1 wherein more than one accumulator is located in the heat transfer medium handling station.

7. The heat transfer system of claim 1 wherein the second helix coil is located in parallel with the first helix coil.

8. The heat transfer system of claim 7 wherein a reclaim valve is located downstream of the compressor and upstream of the first helix coil for directing the heat transfer medium into either the first helix coil or the second helix coil.

9. The heat transfer system of claim 1 wherein the third helix coil is located in parallel with the second helix coil.

10. The heat transfer system of claim 9 wherein a reclaim valve is located downstream of the compressor and upstream of the second helix coil for directing the heat transfer medium into either the second helix coil or the third helix coil.

11. The heat transfer system of claim 1 wherein the second helix coil is located in parallel with the first helix coil and the third helix coil is located in parallel with the second helix coil.

12. The heat transfer system of claim 11 wherein a first reclaim valve is located downstream of the compressor and upstream of the first helix coil for directing the heat transfer medium into either the first helix coil or the second helix coil and a second reclaim valve is located downstream of the compressor and upstream of the second helix coil for directing the heat transfer medium into either the second helix coil or the third helix coil.

13. A heat transfer system comprising:

a) a series of environmental panels for supplying heat values from the ambient atmosphere to a heat transfer medium circulated within the panels, b) a heat transfer medium handling station downstream of the environmental panels having an accumulator and a compressor joined together in fluid communication, c) a first helix coil downstream of the compressor for transferring heat values from the heat transfer medium to water for use in heating a swimming pool, d) a second helix coil downstream of the compressor for transferring heat values from the heat transfer medium to water for use in a hydronic hose for heating the floors of a building, e) a third helix coil downstream of the compressor for transferring heat values from the heat transfer medium to water for use in a hot water tank, f) an air handler downstream of the third helix coil for transferring heat values from the water to air for heating a building, g) a receiver downstream of the helix coils for receiving the heat transfer medium after the heat values have been transferred therefrom, and h) a direct expansion condenser coil located upstream of the receiver for exhausting any excess heat values remaining in the heat transfer medium to the outside atmosphere prior to returning the heat transfer medium to the receiver.

14. The heat transfer system of claim 1 wherein the receiver is joined in fluid communication with the environmental panels so that the heat transfer medium stored in the receiver can be recycled to the environmental panels.

15. The heat transfer system of claim 1 further including a control system means for selectively operating the heat transfer system to selectively provide heating to various uses that require heat and to selectively provide heating to various areas of a building depending on the preference determined by an operator.

16. A heat transfer system comprising:

a) a heat transfer medium handling station having an accumulator and a compressor joined together in fluid communication, b) a first helix coil downstream of the compressor for transferring heat values from the heat transfer medium to water for use in heating a swimming pool, c) a receiver downstream of the helix coil for receiving the heat transfer medium after the heat values have been transferred therefrom, d) a final helix coil downstream of the receiver for transferring heat values from water to the heat transfer medium resulting in a cooled water that is used in an air handler for cooling a building, e) a return line for returning the heat transfer medium from said final helix coil back to the heat transfer medium handling station for recycling through the system, and f) a direct expansion condenser coil located downstream of the first helix coil for exhausting any excess heat values remaining in the heat transfer medium to the outside atmosphere prior to returning the heat transfer medium to the receiver.

17. The heat transfer system of claim 16 wherein a plurality of air handlers are connected in series so that different parts of the building can be selectively conditioned.

18. The heat transfer system of claim 16 wherein the accumulator is located upstream of the compressor.

19. The heat transfer system of claim 18 wherein more than one accumulator is located in the heat transfer medium handling station.

20. The heat transfer system of claim 16 wherein more than one accumulator is located in the heat transfer medium handling station.

21. The heat transfer system of claim 16 wherein a second helix coil is located downstream of the compressor for transferring heat values from the heat transfer medium to water for use in a hydronic hose for heating the floors of a building.

22. The heat transfer system of claim 21 wherein the second helix coil is located in parallel with the first helix coil.

23. The heat transfer system of claim 22 wherein a reclaim valve is located downstream of the compressor and upstream of the first helix coil for directing the heat transfer medium into either the first helix coil or the second helix coil.

24. The heat transfer system of claim 21 wherein a third helix coil is located downstream of the compressor for transferring heat values from the heat transfer medium to water for use in a hot water tank.

25. The heat transfer system of claim 24 wherein the third helix coil is located in parallel with the second helix coil.

26. The heat transfer system of claim 25 wherein a reclaim valve is located downstream of the compressor and upstream of the second helix coil for directing the heat transfer medium into either the second helix coil or the third helix coil.

27. The heat transfer system of claim 24 wherein the second helix coil is located in parallel with the first helix coil and the third helix coil is located in parallel with the second helix coil.

28. The heat transfer system of claim 27 wherein a first reclaim valve is located downstream of the compressor and upstream of the first helix coil for directing the heat transfer medium into either the first helix coil or the second helix coil and a second reclaim valve is located downstream of the compressor and upstream of the second helix coil for directing the heat transfer medium into either the second helix coil or the third helix coil.

29. The heat transfer system of claim 16 further including a control system means for selectively operating the heat transfer system to selectively provide heating to various uses that require heat and to selectively provide cooling to various areas of a building depending on the preferences determined by an operator.

30. A heat transfer system comprising:

a) a series of environmental panels for supplying heat values from the ambient atmosphere to a heat transfer medium circulated within the panels, b) a heat transfer medium handling station downstream of the environmental panels having an accumulator and a compressor joined together in fluid communication, c) a first helix coil downstream of the compressor for transferring heat values from the heat transfer medium to water for use in heating a swimming pool, d) a second helix coil downstream of the compressor for transferring heat values from the heat transfer medium to water for use in a hydronic hose for heating the floors of a building, e) a third helix coil downstream of the compressor for transferring heat values from the heat transfer medium to water for use in a hot water tank, f) an air handler downstream of the third helix coil for transferring heat values from the water to air for heating a building, g) a receiver downstream of the helix coils for receiving the heat transfer medium after the heat values have been transferred therefrom, h) a fourth helix coil downstream of the receiver for transferring heat values from water to the heat transfer medium resulting in a cooled water that is used in the air handler for cooling the building, and i) a return line for returning the heat transfer medium from the fourth helix coil back to the heat transfer medium handling station for recycling through the system.

31. The heat transfer system of claim 30 wherein a first inlet line is connected to a first group of the environmental panels and a second inlet line is connected to a second group of the environmental panels so that the heat transfer medium can be selectively circulated through either the first group, second group or both groups of panels.

32. The heat transfer system of claim 31 wherein the environmental panels are arranged in a row with a panel from the first group alternating with a panel from the second group.

33. The heat transfer system of claim 30 wherein the accumulator is located downstream of the environmental panels and upstream of the compressor.

34. The heat transfer system of claim 33 wherein more than one accumulator is located in the heat transfer medium handling station.

35. The heat transfer system of claim 30 wherein more than one accumulator is located in the heat transfer medium handling station.

36. The heat transfer system of claim 30 wherein the second helix coil is located in parallel with the first helix coil.

37. The heat transfer system of claim 36 wherein a reclaim valve is located downstream of the compressor and upstream of the first helix coil for directing the heat transfer medium into either the first helix coil or the second helix coil.

38. The heat transfer system of claim 30 wherein the third helix coil is located in parallel with the second helix coil.

39. The heat transfer system of claim 38 wherein a reclaim valve is located downstream of the compressor and upstream of the second helix coil for directing the heat transfer medium into either the second helix coil or the third helix coil.

40. The heat transfer system of claim 30 wherein the second helix coil is located in parallel with the first helix coil and the third helix coil is located in parallel with the second helix coil.

41. The heat transfer system of claim 40 wherein a first reclaim valve is located downstream of the compressor and upstream of the first helix coil for directing the heat transfer medium into either the first helix coil or the second helix coil and a second reclaim valve is located downstream of the compressor and upstream of the second helix coil for directing the heat transfer medium into either the second helix coil or the third helix coil.

42. A heat transfer system comprising:

a) a series of environmental panels for supplying heat values from the ambient atmosphere to a heat transfer medium circulated within the panels, b) a heat transfer medium handling station downstream of the environmental panels having an accumulator and a compressor joined together in fluid communication, c) a first helix coil downstream of the compressor for transferring heat values from the heat transfer medium to water for use in heating a swimming pool, d) a second helix coil downstream of the compressor for transferring heat values from the heat transfer medium to water for use in a hydronic hose for heating the floors of a building, e) a third helix coil downstream of the compressor for transferring heat values from the heat transfer medium to water for use in a hot water tank, f) an air handler downstream of the third helix coil for transferring heat values from the water to air for heating a building, g) a receiver downstream of the helix coils for receiving the heat transfer medium after the heat values have been transferred therefrom, h) a fourth helix coil downstream of the receiver for transferring heat values from water to the heat transfer medium resulting in a cooled water that is used in the air handler for cooling the building, and i) a return line for returning the heat transfer medium from the fourth helix coil back to the heat transfer medium handling station for recycling through the system, and j) a direct expansion condenser coil located upstream of the receiver for exhausting any excess heat values remaining in the heat transfer medium to the outside atmosphere prior to returning the heat transfer medium to the receiver.

43. The heat transfer system of claim 30 wherein the receiver is joined in fluid communication with the environmental panels so that the heat transfer medium stored in the receiver can be recycled to the environmental panels.

44. The heat transfer system of claim 30 further including a control system means for selectively operating the heat transfer system to selectively provide heating to various uses that require heat and to selectively provide heating and cooling to various areas of a building depending on the preferences determined by an operator.

* * * * *